United States Patent [19]

Smith

[11] Patent Number: 4,640,770

[45] Date of Patent: Feb. 3, 1987

[54] APPARATUS FOR EXTRACTING WATER FROM SOLID FINES OR THE LIKE

[75] Inventor: Lloyd B. Smith, Bristol, Tenn.

[73] Assignee: United Coal Company, Bristol, Va.

[21] Appl. No.: 831,055

[22] Filed: Feb. 19, 1986

Related U.S. Application Data

[63] Continuation-in-part of Ser. No. 719,534, Apr. 3, 1985, abandoned, which is a continuation-in-part of Ser. No. 436,735, Oct. 26, 1982, abandoned.

[51] Int. Cl.[4] ..... B04B 1/06

[52] U.S. Cl. ..... 210/144; 34/58; 210/360.1; 210/363; 210/376; 210/378; 210/379; 494/36; 494/82; 494/84

[58] Field of Search ..... 34/8, 58; 210/781, 787, 210/144, 297, 360.1, 360.2, 363, 364, 366, 368, 372, 376, 378, 379, 380.3, 382, 512.1; 494/36, 82, 83, 84

[56] References Cited

U.S. PATENT DOCUMENTS

| | | | |
|---|---|---|---|
| 1,600,249 | 9/1926 | Sando | 210/144 |
| 1,827,648 | 10/1931 | Green | 57/76 |
| 1,965,840 | 7/1934 | Jones | 210/139 |
| 2,008,037 | 7/1935 | Quantin | 57/76 |
| 2,138,476 | 11/1938 | Jones | 210/768 |
| 2,155,919 | 4/1939 | Wooler et al. | 308/184 |
| 2,271,493 | 1/1942 | Brewer | 210/100 |
| 2,598,726 | 6/1952 | Stempel | 101/217 |
| 2,779,434 | 1/1957 | Smith | 55/271 |
| 2,783,100 | 2/1957 | Steeneck | 308/15 |
| 2,933,354 | 4/1960 | Primeau | 308/184 |
| 3,097,167 | 7/1963 | Beyerle | 494/15 |
| 3,136,721 | 6/1964 | Gooch | 210/376 |
| 3,228,596 | 1/1966 | Reed | 494/82 |
| 3,248,046 | 4/1966 | Feltman | 494/16 |
| 3,255,959 | 6/1966 | Smith | 210/213 |
| 3,275,152 | 9/1966 | Searle | 210/364 |
| 3,282,498 | 11/1966 | Smith | 403/52 |
| 3,319,880 | 5/1967 | Pause | 494/36 |
| 3,321,941 | 5/1967 | Ellis | 68/24 |
| 3,338,417 | 8/1967 | Heckmann et al. | 210/380.3 |
| 3,483,601 | 12/1969 | Van Piel | 210/372 |
| 3,494,327 | 2/1970 | Pearson | 494/36 |
| 3,606,143 | 9/1971 | Stallmann | 494/82 |
| 3,608,395 | 9/1971 | Brandt | 74/572 |
| 3,608,732 | 9/1971 | Steprath | 210/364 |
| 3,718,220 | 2/1973 | Titus | 210/374 |
| 3,731,394 | 5/1973 | Onishi | 34/58 |
| 3,797,737 | 3/1974 | Kadotani et al. | 494/81 |
| 3,913,828 | 10/1975 | Roy et al. | 494/81 |
| 3,946,940 | 3/1976 | Tadokora | 494/36 |
| 3,983,035 | 9/1976 | Arkeveld et al. | 210/144 |
| 3,993,243 | 11/1976 | Dietzel et al. | 494/36 |
| 4,069,967 | 1/1978 | Crosby et al. | 494/82 |
| 4,224,165 | 9/1980 | Laven et al. | 210/363 |
| 4,236,426 | 12/1980 | Meinke et al. | 74/574 |
| 4,257,495 | 3/1981 | de Brie Perry | 308/26 |
| 4,269,711 | 5/1981 | Gerteis | 210/380.3 |
| 4,362,619 | 12/1982 | Bange | 210/360.1 |
| 4,386,122 | 5/1983 | Birdsall | 210/360.1 |
| 4,412,831 | 11/1983 | Avery et al. | 494/82 |
| 4,449,966 | 5/1984 | Piramoon | 494/82 |
| 4,518,621 | 5/1985 | Alexander | 210/781 |

FOREIGN PATENT DOCUMENTS

| | | | |
|---|---|---|---|
| 2093719 | 9/1982 | United Kingdom | 494/36 |

*Primary Examiner*—Peter Hruskoci

*Attorney, Agent, or Firm*—Jennings, Carter, Thompson & Veal

[57] ABSTRACT

A batch-type centrifugal system utilizes a gimbal-like suspension at the end of a rotating shaft distal an attached bowl at the other end of the shaft. The shaft rotates within an elongated bearing which is supported proximal the bowl by a support which is selectively variable in resiliency. This variation in resiliency changes the natural radial frequency of the system whereby operation of the system at rotational speeds which correspond to the natural radial frequency may be minimized, thereby effecting smooth loading, drying, and unloading operations.

30 Claims, 9 Drawing Figures

17
26
22
23
37
38
36
33
34
31
28
27
3
3
18
56
16
59
54
62
61
57
58
13
14

FIG. 7
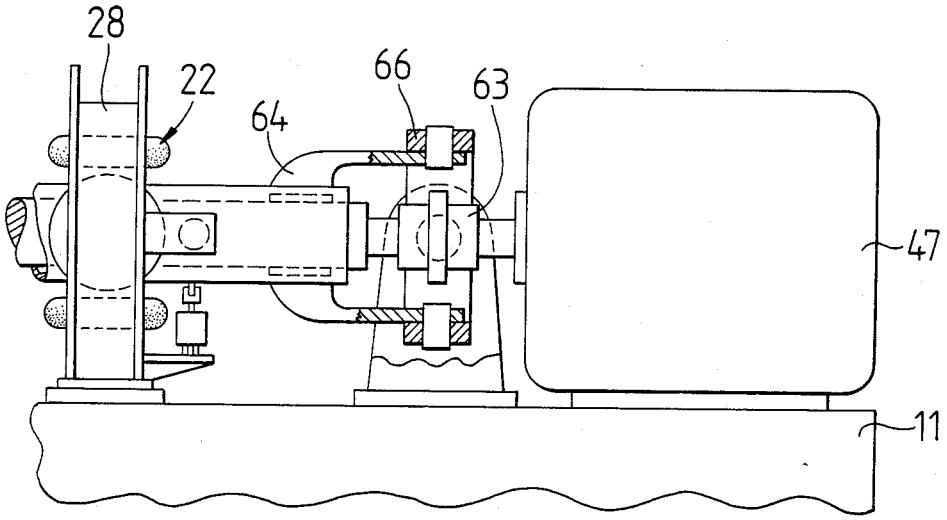
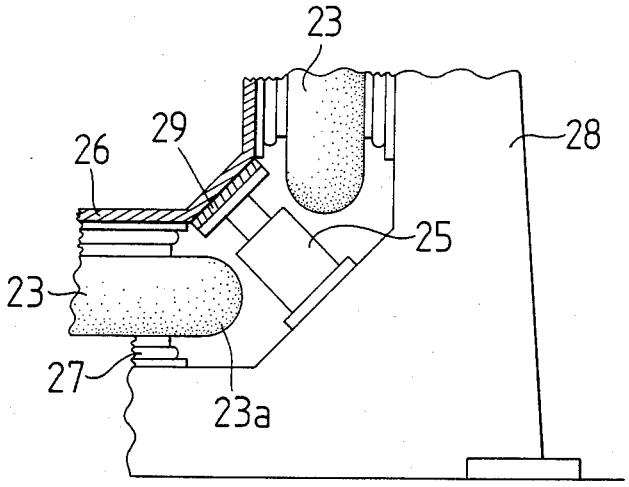
FIG. 3A

APPARATUS FOR EXTRACTING WATER FROM SOLID FINES OR THE LIKE

This is a continuation-in-part of application Ser. No. 719,534, filed Apr. 3, 1985 now abandoned, which was a continuation-in-part of U.S. patent application Ser. No. 436,735, filed Oct. 26, 1982 now abandoned.

BACKGROUND OF THE INVENTION

The present invention relates to the field of centrifugal removal of fluids from solid fines such as ore slurries, industrial wastes, coal, and the like. More particularly the present invention relates to an improvement in batch-type centrifugal fine solids drying systems. In even greater particularity the present invention may be described as an improvement in batch-type centrifugal fine-solid drying systems for stabilizing a gimbal-mounted shaft and bowl combination under high speed cut-out and loading conditions, with said drying system utilizing very high speed rotation to achieve a surface moisture content of less than ten per cent.

In the art to which this invention relates, the problems of operating batch-type centrifuges with their less than perfectly balanced loads of fine particulate at the very high speeds necessary for drying to extremely low moisture levels have not been solved. That is, in prior apparatus the constructions used would be unsafe or too expensive for use at the high production rates and at the very high speeds necessary to dry fine particulate to very low moisture levels for practical costs. In addition, the prior art has not addressed the problems of cutting out the fine dried particulate at higher speeds on a dynamic suspension system capable of safe and economical operation.

By way of example, the coal industry has an urgent need for an improved means for drying coal fines smaller than 100 mesh size in an economical manner with minimal pollution and safety problems. Prior commercial centrifuges for this service fall into three principal catagories:

(1) Solid bowl decanters with screws for advancing the solids through the bowls;

(2) Screen bowl centrifuges with screws for advancing the solids through the bowls; and (3) Batch centrifuges, similar to that shown in U.S. Pat. No. 2,271,493 which receive moist particulate at low speeds, raise the bowl speed to a higher speed for drying, and then slow down again for removal of the dried solids. Some of the prior batch-type centrifuges have crude resilient suspension means, U.S. Pat. 3,275,152 for example, but they have been unsuitable for the very high speeds and high production rates needed to economically dry very fine coal.

None of these three types of existing centrifuges can obtain a high enough gravity level to dry sub 100 mesh size coal to below twenty to thirty per cent surface moisture. Furthermore, the screen bowl centrifuges lose most of the coal of less than 325 mesh size through the screen. Consequently coal cleaning plant operators who want their fine coal dried to below twenty per cent moisture are left with the choice of using thermal dryers or press-type dryers. Both of these are expensive. Press-type dryers cannot dry very fine coal below fifteen to twenty per cent surface moisture. Thermal dryers, although unsafe and potentially environmentally pollutant, can dry fine coal below ten per cent surface moisture; however, they cannot handle very fine coal unless it is mixed with coarse coal and thermally dried coal fines are dusty and will blow away during transportation.

SUMMARY OF THE INVENTION

It is an object of the present invention to provide a centrifuge construction which will dry moist fine particulate to lower moisture levels than has been possible with prior art large scale centrifuges.

Another object of the invention is to dry fine moist particulate without causing pollution problems, safety hazards or significant losses of particulate in the fluid extracted from the particulate.

Another object of the invention is to provide a batch-type centrifuge capable of handling unbalanced loads at very high drying speeds.

Yet another object of the invention is to provide a batch-type centrifuge capable of cutting out dried solids at rotational outer surface speeds equivalent to at least forty-five hundred feet per minute.

Still another object of the invention is to provide a high production batch-type centrifuge which can be filled at rotational outer surface speeds in excess of 11,000 feet per minute.

Yet another object of the invention is to provide a batch-type centrifuge which can operate smoothly, safely, and economically with unbalanced loads by virtue of its ability to change either the natural radial frequency of the system or the rate of radial energy absorption from the rotating elements.

Yet another object of my invention is to provide a suspension means for a high speed batch centrifuge which reduces the stress placed on the centrifuge's rotating shaft and therefore permits the use of smaller shafts than heretofore used for such applications.

My invention accomplishes these objects through the utilization of a unique mounting arrangement which takes advantage of the natural physical tendencies of rotating elastic bodies. An elastic body, to wit, the bowl and shaft of a centrifuge, will vibrate freely at one or more of its natural frequencies if its equilibrium is momentarily disturbed by an external force. If the external force is applied repeatedly the elastic body will vibrate at the frequency of the external excitation. A rotating elastic system will have critical operating speeds at which objectionable vibrations are likely to occur. These speeds correspond to the various natural frequencies of the system. Since imbalances will always exist in the system, there will always be an excitation force with a frequency corresponding to the operating speed. When one of the system's natural frequencies coincides with the rotational frequency of the system, resonance results with maximum vibration of the system. The natural frequencies and consequently the critical speeds are not merely a property of the rotating shaft alone, rather they are also affected by the bearings, the supports, and the foundation; thus variation in these contributing factors will result in a variation of the natural frequencies and the critical speed.

My invention utilizes supporting elements of variable resiliency to alter the natural radial frequency of the system. A batch-type centrifuge by design rotates at a variable speed which ranges from a relatively low cut-out speed for removal of the dried fines, a moderately higher loading speed and a very high drying speed. Consequently, the rotational speed of the centrifuge will transition through a critical speed or be required to operate for a time at a critical speed corresponding to the natural radial frequency. By varying the resiliency of my supports, I am able to shift the natural radial frequency so that the transition across the critical speed is almost instantaneous or I can shift the radial natural frequency so that the centrifuge may operate for a period of time, such as at cut-out, at a speed corresponding to a frequency below the natural radial frequency.

The operating speed is not the only factor contributing to the amplitude of the vibration at resonance. Another very important factor is the damping of the system. Damping, however, is both friend and foe to a system which must operate over a wide range of speeds. At resonance, it is desirable for the actual damping to approach the critical damping of the system, thereby taking energy from the shaft and decreasing the amplitude of the vibration of the system. At the much higher drying speeds, it is desirable for actual damping to be minimal in order to efficiently utilize the energy of the system in rotating the shaft and bowl. Therefore, in my invention I use a variable rate energy absorption means as a damper to stabilize the bowl against excessive radial excursions during cut-out at speeds near resonance, and to allow the system to vibrate freely at the higher drying speeds.

My invention utilizes an overhung bowl; therefore, in order to accurately control the radial vibration of the system there must be a means of maintaining the vertex of the system within a well defined locus. This is accomplished by a gimbal-like mounting system at the end of the shaft opposite the bowl attachment, in the locus of the vertex of precession of the system. This gimbal-like mounting and the utilization of a drive means inputting rotational force proximal the vertex minimizes the radial vibration at the vertex and the external excitation to the rotating elements and isolates the support structure from receiving radial vibration transmitted at the vertex of the system.

Briefly then, my invention utilizes a generally cylindrical bowl having a plurality of apertures through which extracted fluid may be removed to a surrounding envelope for collection and removal. The bowl is attached to one end of an elongated continuous shaft which is gimbal mounted at the opposite end thereof. A variable speed drive is operatively connected to the shaft proximal the gimbal-like mounting to rotate the shaft and bowl at the various speeds required. The shaft is mounted in an elongated bearing which is carried by support means intermediate the bowl and the gimbal-like mounting with the support means being variable in resiliency.

DESCRIPTION OF THE DRAWINGS

Further features and advantages of my invention will become apparent from a study of the detailed description of the preferred embodiment in conjunction with the appended drawings which form a portion of this application, wherein:

FIG. 3A is a sectional view of a cylinder mounted support;

DESCRIPTION OF A PREFERRED EMBODIMENT

Figure 1:
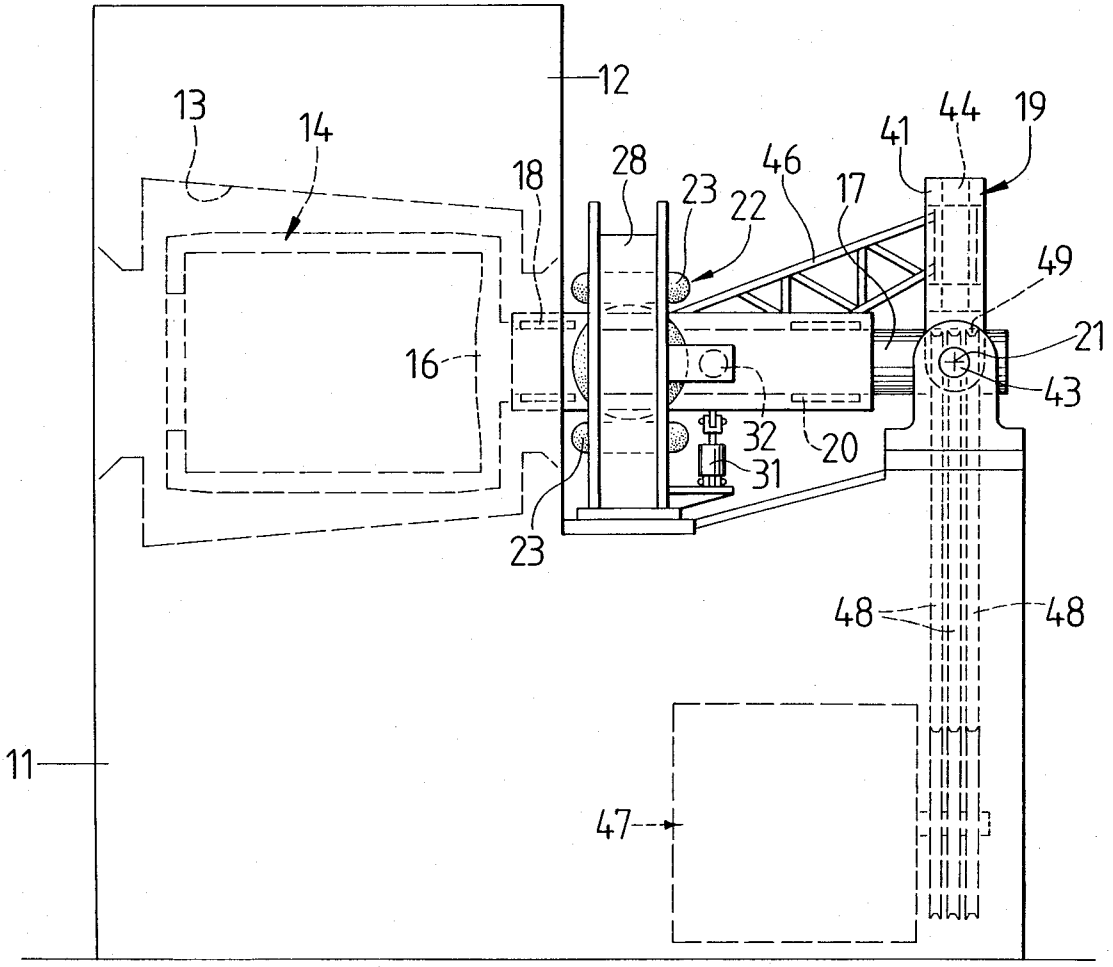
FIG. 1 is a side elevational view showing the improved centrifuge.

Referring to FIG. 1, my invention utilizes a base frame member 11 including an upper housing 12 which carries an envelope 13 therewithin which incases a bowl 14. The envelope 13 is used to confine and remove fluids extracted from the fines within the bowl 14 as is well known in the art. The particular structure of the bowl 14 will be discussed hereinafter. The bowl 14 has a base support 16 affixed conventionally to a continuous rotatable shaft 17 which rotates within longitudinally extending bearings 18 and 20. The end of the shaft 17 opposite the bowl 14 is mounted for rotation on a gimbal-like system 19. The gimbal-like system 19 is affixed to and supports the shaft 17 whereby there is maintained a vertex of precession of the shaft 17 and bowl 14 indicated by the numeral 21. Supporting the bearings 18 intermediate the bowl 14 and the vertex 21 proximal the bowl is a resilient support structure 22 shown more fully in FIGS. 2 and 3.

Figure 3:
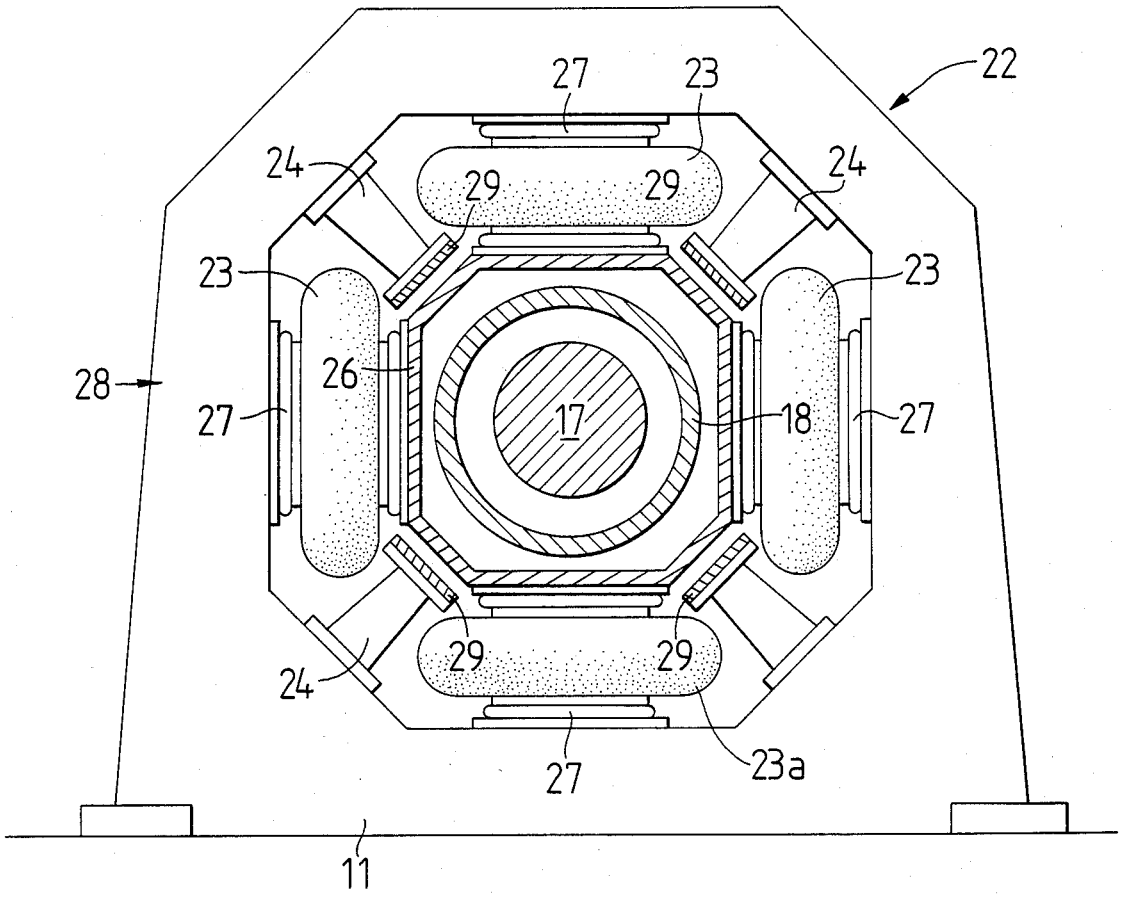
FIG. 3 is a sectional view along line 3—3 of FIG. 2.
Figure 4:
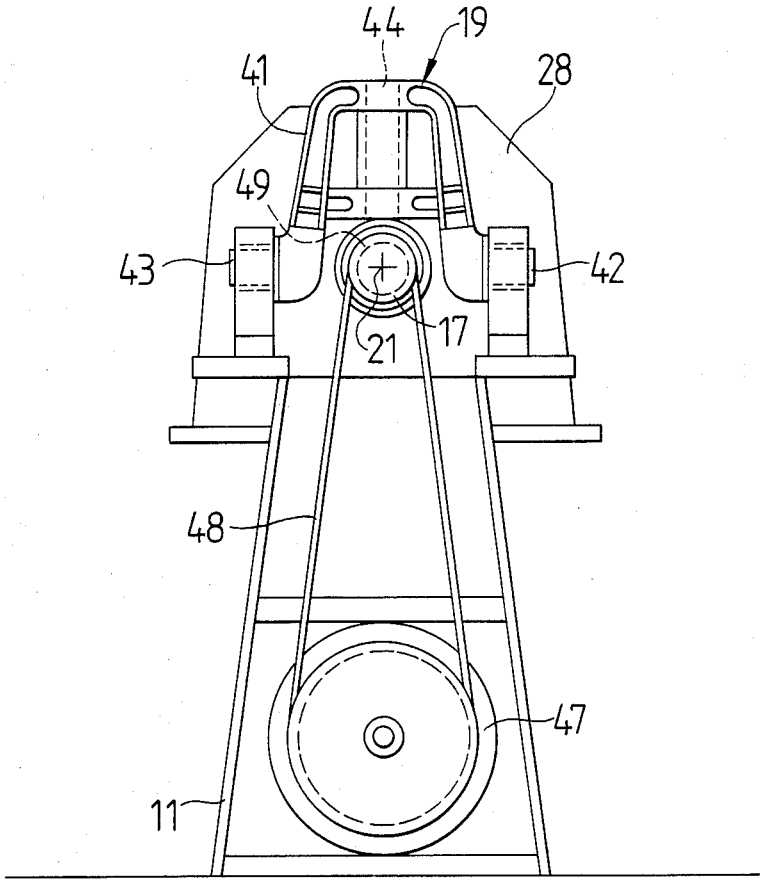
FIG. 4 is an end view of the drive means including the gimbal-like mount for the rotating shaft.

The resilient support structure 22 has two principal types of components, with one being in the form of air bags 23 and the other in the form of semi-rigid supports 24. The air bags 23 and semi-rigid supports 24 are symetrically positioned about a bearing sleeve 26 containing the bearings 18 and the shaft 17 so that the structure 22 supports the bearings 18 at an area near the bowl 14. As illustrated, the semi-rigid supports 24 are placed intermediate each pair of air bags 23; however it is to be understood that the supports 24 may be integrated within the air bags 23 as long as the air bags 23 provide the sole support to the bearing sleeve 26 when they are fully inflated. The supports 24 may also be mounted on fluid actuated cylinders 25, as shown in FIG. 3A. The air bags are mounted to the base frame 11 by connecting members 27 extending radially inwardly from a mounting collar 28 affixed to the base frame 11. A source of compressed air, not shown, is used to individually control the inflation of each air bag 23. The semi-rigid supports 24 are also mounted to the collar 28 and extend radially inwardly therefrom, as shown in FIG. 3. The supports 24 include rubber pads 29 on the inwardly facing ends thereof, with the pads 29 being separated from the sleeve 26 when the air bags 23 are inflated and with the lower pads 29 abutting the sleeve 26 upon deflation of some of or all of the air bags 23.

Figure 2:
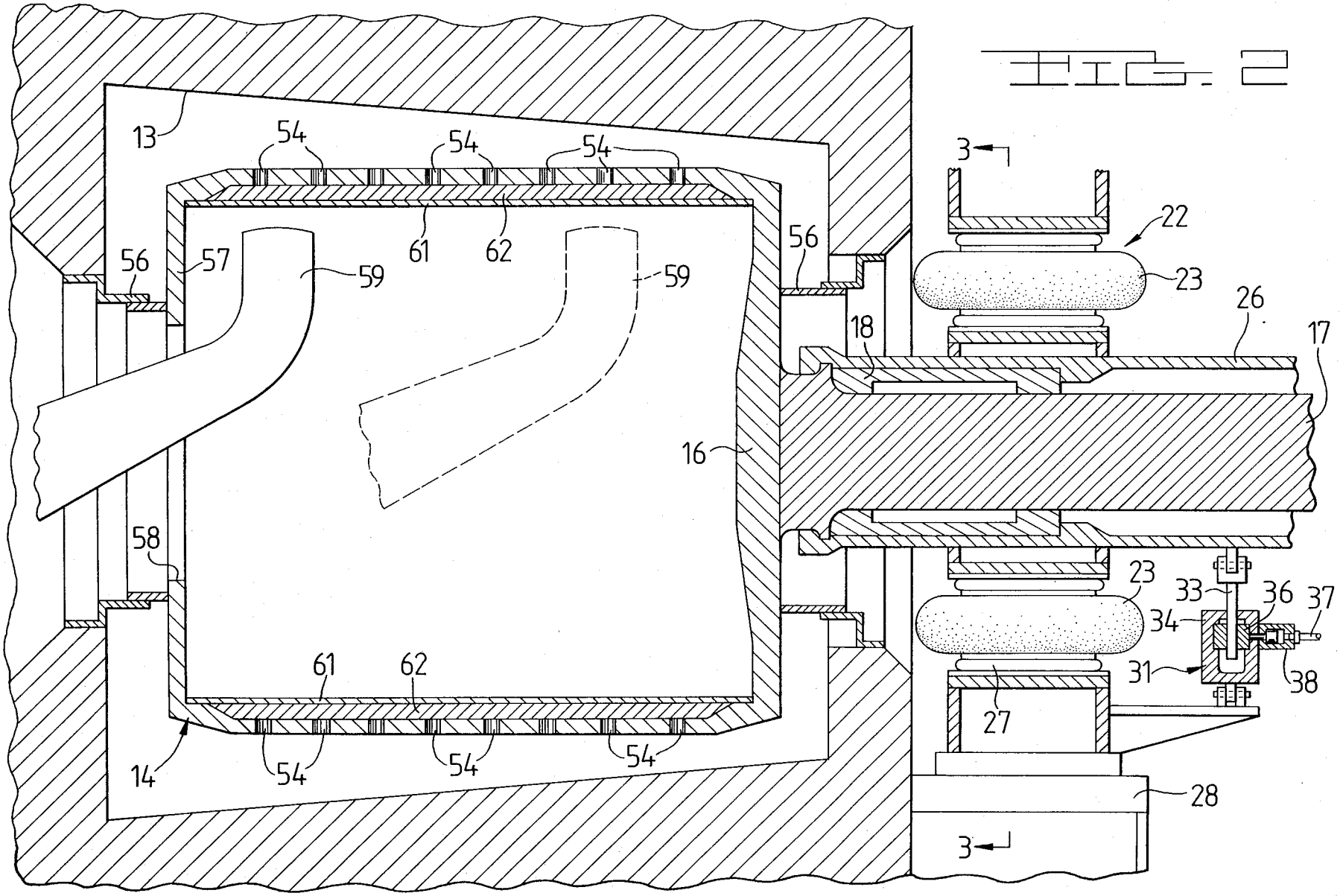
FIG. 2 is a sectional view along the axis of the shaft showing the bowl, envelope and a portion of the resilient support.

Also shown in FIGS. 1 and 2 are a pair of radially extending shock absorbers 31 and 32 which are mounted between the sleeve 26 and the collar 28 at angularly spaced locations relative to each other. The shock absorbers 31 and 32 are used to dampen the system from excessive radial motion such as may occur at resonance. It is preferable that the energy absorption capabilities of these shock abosrbers be variable so that they may stabilize the bowl 14 at cut-out speeds for the removal of the dried particulate and yet absorb minimal energy at the drying speeds; however standard industrial shock absorbers may be used. One such variable shock absorber 31 is shown in FIG. 2. The shock absorber 31 uses a flat bar 33 operatively connected to the sleeve 26 and extending into a housing 34 within which a hydraulically actuated clamp 36 is positioned to open and close about the bar 33. The pressure exerted on the bar 33 is determined by the hydraulic pressure provided to a hydraulic line 37 and cylinder 38 from an external hydraulic source, not shown.

The gimbal-like system 19 is located at the end of the shaft 17 opposite the end thereof carrying the bowl and includes a yoke 41 having pins 42 and 43 extending transversely therefrom. The pins 42 and 43 are pivotally secured to the base frame 11. A vertical pin 44 extends downwardly from the yoke 41 and supports one end of a truss 46 which is connected at its opposite end to the sleeve 26 to support the shaft 17. The shaft 17 is restrained from axial movement within the sleeve 26. This gimbal-like system 19 allows the bowl 14 and shaft 17 to be displaced vertically and horizontally within the restriction placed on the shaft 17 by the resilient support structure 22 while maintaining the vertex 21 of precession of the shaft 17 at a substantially well defined locus. A variable speed drive 47, such as a variable frequency alternating current drive, is coupled to the shaft 17 by at least one drive belt 48 which transfers rotational force to the shaft 17 at a belt receiving groove 49 located at the locus of the vertex 21. Or, as shown in FIG. 7, the drive means may be directly coupled to the shaft 17 with a flexible coupling 63 such as a gear-type flexible coupling which is well known in the art. Alternative drive means such as variable speed direct current drives or hydrualic variable speed drives may also be used. The use of the flexible coupling 63 requires the use of a gimbal fork 64 and gimbal ring 66 rather than the aforementioned yoke 41 and truss 46, however their purpose and operation are the same; that is, to isolate the rotating elements from the remainder of the centrifuge and to maintain the vertex 21 in a well defined locus.

The use of the gimbal-like system 19 resolves the three-dimensional vibration problem into a two-dimensional problem at the mounting collar 28 while isolating the base frame 11 from receiving excessive vibration which would result if a fixed bearing support system were used to support the shaft 17. This allows for the use of a very high rate of rotation which places very high gravity stresses on the loaded bowl 14. Therefore the bowl construction merits discussion in that the preferable construction of bowl 14 utilizes a composite material, such as a carbon fiber reinforced epoxy, due to its combined strength, stiffness, and durability. Such composite materials have a very high strength-to-weight ratio and thus give marked advantages over other materials.

Figure 5:
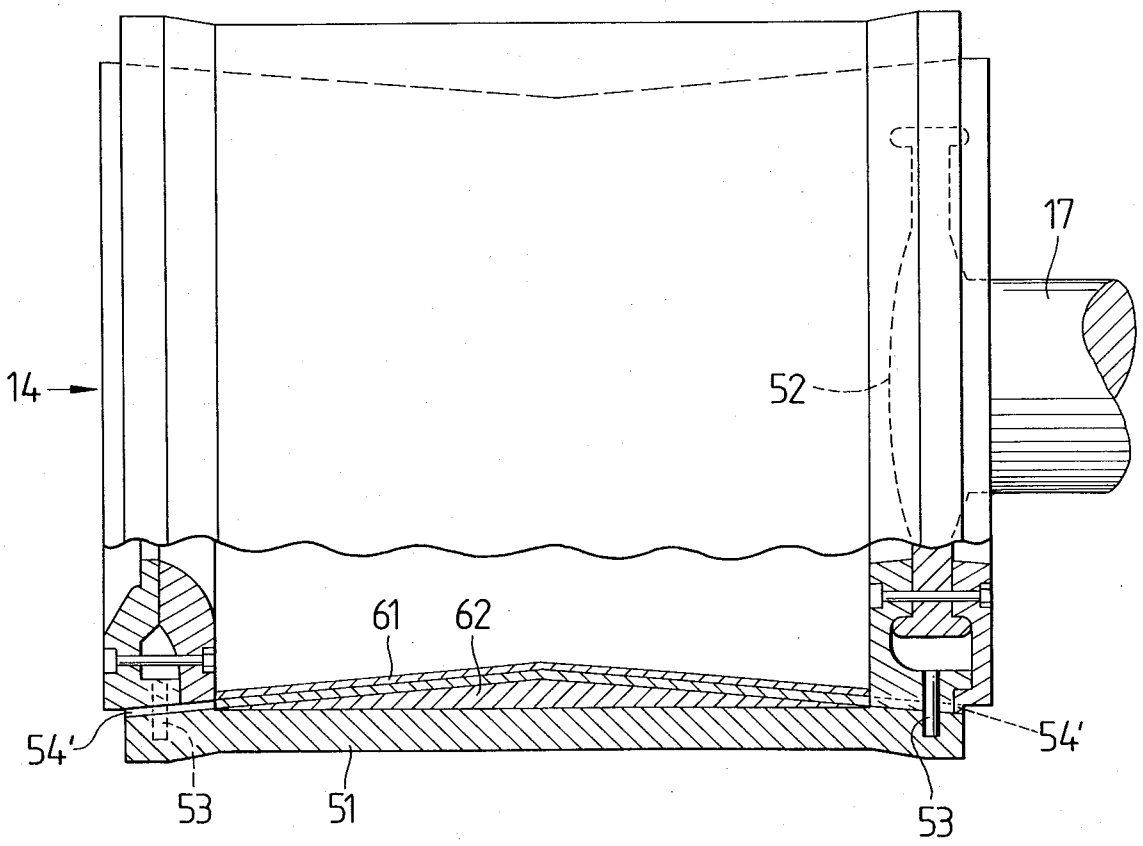
FIG. 5 is a partial sectional view along the axis of the shaft and bowl showing the pin construction of a metallic bowl.

In some applications it may be useful to use an expandable metallic bowl, as shown in FIG. 5, which utilizes an expandable shell 51 attached to a base support 52 by a plurality of radially extending pins 53 which allow the shell to expand under stress as is well known in the art exemplified in U.S. Pat. No. 3,232,498.

Regardless of the bowl construction materials, the bowl 14 is substantially circular in cross section as viewed along the axis thereof and has a plurality of generally outwardly directed angularly spaced apertures or discharge ports 54 which allow the extracted fluids to exit the bowl into the envelope 13 from whence the fluids are conventionally removed. In the metallic bowl an imperforate shell 51 with substantially axially directed ports 54' at the ends of the bowl are preferred, while in the composite bowl construction radially directed ports 54 are preferred. In order to prevent the unintentional discharge of fluids from the envelope 13 into the bowl or along the shaft, ring seals 56 are carried between the bowl 14 and the housing 12. The bowl 14 has a radially and inwardly extending annular lip 57 of a radial dimension substantially equal to the thickness of the particulate deposited in the bowl adjacent the lip 57. The lip 57 carries one set of ring seals 56 and defines a generally unobstructed opening 58 into the bowl 14. This opening 58 provides both ingress and egress for the particulate matter which may be introduced and removed by any of a number of conveyors, sprayers, scrapers, blades and the like as may be convenient with the particulate matter being dried and as is indicated schematically at 59 in FIG. 2. The bowl contains a filter media 61 of an appropriate mesh size for the particulate matter and a filter media support 62 which supports the filter media 61 and allows extracted fluid to exit the bowl 14. In the metallic bowl construction, as shown in FIG. 5, and in the bowl utilizing the composite material the filter media 61 and filter media support 62 may be peaked near the center of the shell 51 and flare outwardly toward each end to bias the flow of extracted fluids toward the axially directed ports 54' under enhanced radial gravity.

My device operates as a batch centrifuge with continuous rotational movement. That is, the wet particulate matter is introduced into the bowl 14 while the bowl 14 is rotating and is cut-out or removed from the bowl 14 while the bowl 14 is rotating. Between the time the particulate is introduced and the time the dried particles are removed, the bowl is accelerated to the drying speed. My centrifuge operates at higher speeds than conventional batch centrifuges in that my minimum speed occurs at outer surface cut-out speeds of more than 4500 feet per minute and my bowl outer surface speed during loading exceeds 11,000 feet per minute and my bowl outer surface drying speed is in excess of 18,000 feet per minute.

It will be appreciated that removing the particulate from the bowl at this high cutout speed requires that the bowl 14 be relatively stable. However, the natural radial frequency of the system when supported on the air bags 23 is about 700 to 800 cycles per minute or about 5400 to 6200 feet per minute outer surface speed when a 29½ inch outside diameter bowl is used. Thus, it can be seen that the cut-out speeds will include a rotational speed corresponding to the natural radial frequency and resonance will result.

Figure 6A:
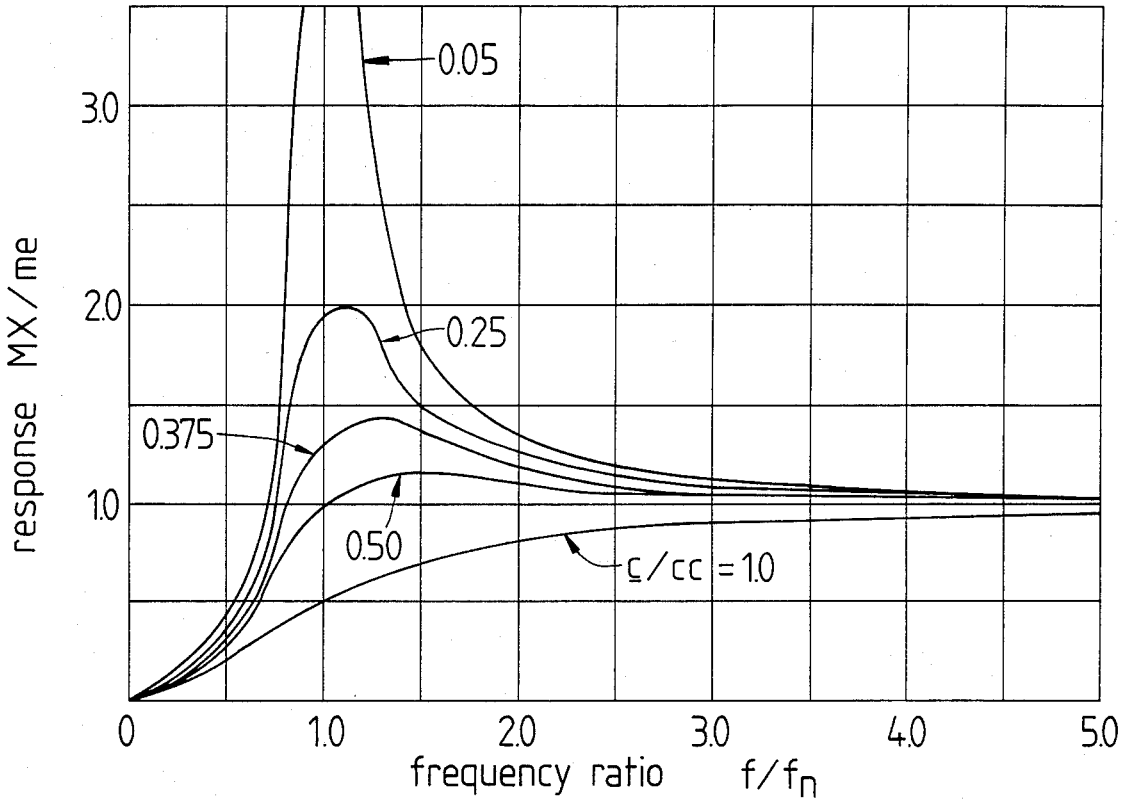
FIGS. 6A and 6B are graphic illustrations of the response amplitude and phase angle of an elastic body at various frequency ratios; and, FIG. 7 is an elevational view partially in section showing a flexible coupling of the motor to the shaft.
Figure 6B:
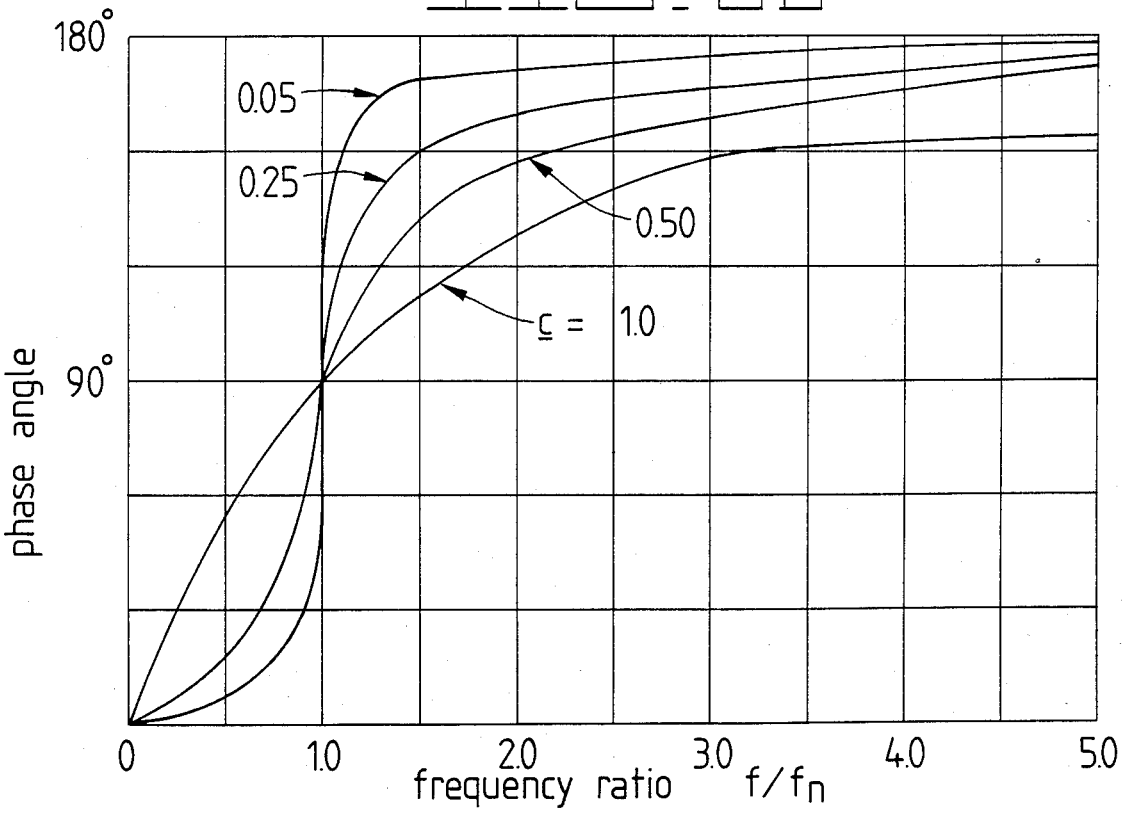

FIGS. 6A and 6B derived from Fan Engineering, edited by Robert Jorgenson and published by Buffalo Forge Co., illustrates the problem associated with rotating an elastic system with an unbalanced load at resonance. At drying speeds the rotational frequency f for a 29½ inch outside diameter bowl, for example, is usually 2400 rpm or greater and the shaft is supported on the air bags 23, thus the natural radial frequency fn is 700–800 cycles per minute, so that the frequency ratio f/fn is approximately 3.0 or greater. At this ratio the amplitude of the non-dimensional response Mx/me for the forced vibration of a system resulting from rotating imbalance is approximately 1.0. The total vibrating mass M includes the rotating mass m which has an eccentricity of e, the system amplitude is x and the phase angle or lag of the response behind the imbalance is $\phi$. The curved lines on the Figures correspond to the response and phase angles at various ratios C between the actual damping on the system c, and the critical damping cc of the system. As will be noted at the drying speed the response will be approximately equal in amplitude to the imbalance and lag behind the imbalance by nearly 180°; thus the system will be self-balancing at the drying speed, particularly if the system has a damping ratio which is very small, such as 0.05. Therefore, at drying speeds it is desirable that the shock absorbers 31 influence the system minimally.

In contrast to this for example at cut-out speeds for a 29½ inch outside diameter bowl of between 600 and 1000 rpm the frequency ratio f/fn with air bag support will at some point become 1.0 and the respons Mx/me, with a minimal damping ratio C of 0.05, will increase well above the scale of the graph. Also the phase angle approaches 90°. The result is that the system undergoes tremendous vibration, which is totally undesirable in that the removal/loading element 59 may impact and damage the filter media 61.

In order to alleviate the problem, one of the air bags 23*a* is deflated as the rotational speed of the bowl 14 is reduced from the drying speed, and the bearing is then supported by the semi-rigid supports 24. Alternatively, supports 24 are moved into engagement with the bearing by a fluid pressure operated cylinder 25 as shown in FIG. 3A. The support structure 22 is thereby changed to a less resilient or stiffer support which increases the natural radial frequency fn of the system and increases the hysteresis of the supports. That is to say, the rubber pads 29 and support 24 removed energy from the system. Inasmuch as the rate of rotation of the shaft is decreasing rapidly during the cutting out operation and the change in natural radial frequency is also quite rapid the transition through the rotational speed f corresponding to the natural radial frequency fn is quite rapid and the effects of resonance are minimal. During removal of the particulate fn is above cut-out speed, thus the frequency ratio f/fn is less than 1.0; thus the ampltiude of the response Mx/me is not as severe and the phase angle is less than 90°. At this point the shock absorbers 31 interact with the shaft to increase the damping ratio C which further reduces the amplitude of the response Mx/me by taking energy out of the system. The bowl 14 is thus stabilized against excessive radial movement and the cutting out of the dried particulate can proceed safely. It is noteworthy to mention that the dried particulate removed is not dusty but, rather, has a consistency somewhat like table salt; therefore it is not as subject to the same transportation losses due to dusting as thermally dried particulate would be.

In completing the cycle, upon completion of the cut-out operation, the bowl's rotational speed is increased. For example, with a 29½ inch outside diameter bowl the speed is increased to above 1400 rpm and wet particulate is introduced. As the speed increases the air bag 23*a* is reinflated and thus the natural radial frequency fn is decreased, such that the transition across the resonance speed is again quite brief, thereby causing no problems with excessive radial excursions. The bowl is then accelerated to drying speeds, usually in excess of 2400 rpm for a 29½ inch outside diameter bowl. The entire cycle takes as little as ninety seconds. It will be noted that the resilient support 22 incorporates a built-in safety feature due to its double support system. In the event of a failure of an air bag 23, the bearing sleeve 26, bearing 18, and shaft 17 will be engaged by the lower semi-rigid supports 24 and the centrifuge may be safely stopped.

It is to be understood that the curves of FIGS. 6A and 6B are idealized curves for a system having one degree of freedom; however my gimbal-like system 19 yields a system with only two degrees of freedom which are both radial to the bowl; thus the principles involved yield the same results, to wit: my apparatus by virtue of its ability to vary the natural radial frequency of the system in a controlled manner coupled with its ability to vary the rotational speed of the system can control the duration of the transition across a critical speed and thus minimize excessive vibration; can operate at cut-out speeds higher than prior art centrifuges; can transition from cut-out speeds to drying speeds and back more smoothly and more efficiently than prior centrifuges; can use lighter-weight materials for the shaft due to the reduction of vibratory stress; can process particulate matter more rapidly and economically; is less subject to fatigue or wear due to excessive vibration; and is simpler and cheaper to construct and operate than are prior centrifuges.

While I have shown my invention in various forms, it will be obvious to those skilled in the art that it is not so limited, but is susceptible of various other changes and modifications without departing from the spirit thereof.

What I claim is:

1. In a centrifuge including an evelope for collecting fluid extracted thereby, means for introducing wet particulate solids into said centrifuge and means for removing dried solids from said centrifuge, the improvement comprising:

(a) a bowl mounted for rotation within said envelope and having an unobstructed opening at one end thereof for receiving said wet particulate solids, a base support closing the other end of said bowl and a plurality of outlet ports for discharging fluid into said envelope;

(b) a filter media liner proximal the inner surface of said bowl;

(c) means between said filter media liner and said bowl for allowing extracted fluid to move outwardly of said filter media liner;

(d) a continuous shaft fixed to said base support at one end and rotatably mounted at a second end on a gimbal-like system to maintain a vertex of precession of said shaft and bowl at said second end in a substantially well defined locus;

(e) variable speed drive means connected to said shaft adjacent said vertex to effectively rotate said bowl for centrifugally extracting fluids from said wet particulate solids; and (f) resilient means supporting said shaft and bowl on bearings, located intermediate said vertex and said base support, with said resilient means for supporting said shaft being variable in resiliency and constructed to vary the natural radial frequency of said bowl and shaft in accordance with the speed of said drive means.

2. The improvement as defined in claim 1 wherein said bowl is a composite fiber reinforced unit.

3. The improvement as defined in claim 1 wherein said bowl is a metal drum with an expandable outer shell.

4. The improvement as defined in claim 1 wherein said variable speed drive means is connected to said shaft by at least one drive belt.

5. The improvement as defined in claim 1 wherein said resilient means is adapted to provide a high natural radial frequency when said shaft is rotating at cut-out speeds to remove dried solids and a low natural radial frequency when said shaft is rotating at drying speeds.

6. The improvement as defined in claim 1 wherein said resilient means comprises:

(a) a plurality of air bags mounted about said bearings; and (b) a plurality of movable support members having a resiliency less than said air bags mounted about said bearings in cooperation with said air bags, whereby said support members may be urged against said bearings.

7. The improvement as defined in claim 1 wherein said variable speed drive means is operably connected to said shaft by a flexible coupling.

8. The improvement defined in claim 1 wherein said resilient means comprises:

(a) a plurality of air bags mounted about said bearings, with the inflation of each bag being independently controlled; and (b) a plurality of support members having a resiliency less than said air bags mounted about said bearings in cooperation with said air bags, whereby said bearing may be urged against selected ones of said support members by varying the inflation of selected cooperative air bags.

9. The improvement defined in claim 8 further comprising energy adsorption means operatively connected to said bearing intermediate said bowl and said gimbal-like system for absorbing energy from said shaft and bowl when said shaft is rotating near the natural radial frequency to stabilize said bowl at cut-out speeds.

10. The improvement defined in claim 9 wherein said energy absorption means is a plurality of shock absorbers extending radially of said bearing and attached thereto.

11. The improvement defined in claim 9 wherein said energy absorption means comprises shock absorbers of variable energy absorption capability adapted to absorb more energy at cut-out speeds whereby said bowl is stabilized from excessive radial vibration and to absorb minimal energy at drying speeds.

12. The improvement as defined in claim 9 wherein said variable speed drive means is connected to said shaft proximal said vertex by at least one drive belt.

13. The improvement as defined in claim 9 wherein said resilient means is adapted to provide a high natural radial frequency when said shaft is rotating at cut-out speeds to remove dried solids and a low natural radial frequency when said shaft is rotating at drying speeds.

14. The improvement of claim 13 wherein said resilient means includes a plurality of air bags mounted symetrically about said bearing, with the inflation of each bag independently controlled.

15. The improvement defined in claim 8 wherein said plurality of air bags and said plurality of support members are cooperatively and symetrically positioned about said bearing whereby said bearing is supported by said support members upon deflation of said air bags.

16. The improvement defined in claim 15 further comprising energy absorption means operatively connected to said bearing intermediate said bowl and said second end of said shaft for absorbing energy from said shaft when said shaft is rotating at cut-out speeds to stabilize said bowl against excessive vibration.

17. The improvement defined in claim 15 further comprising a plurality of shock absorbers mounted radially of said bearing and attached thereto.

18. The improvement defined in claim 15 further comprising shock absorbers of variable energy absorption capability adapted to absorb more energy when said shaft is rotating at cut-out speeds to remove dried solids and to absorb minimal energy when said shaft is rotating at drying speeds, with said shock absorbers being connected radially about said bearing intermediate said bowl and said second end whereby said bowl is stabilized against excessive radial movement at cut-out speeds.

19. The improvement defined in claim 1 further comprising energy absorption means operatively connected to said bearing intermediate said bowl and said second end, for stabilizing said bowl against excessive radial motion by absorbing energy from said shaft and bowl when said shaft is rotating at cut-out speeds.

20. The improvement defined in claim 1 further comprising shock absorbers mounted radially of said bearing intermediate said bowl and said second end.

21. The improvement defined in claim 1 further comprising shock absorbers of variable energy absorption capability, radially attached to said bearing intermediate said bowl and said second end and adapted to absorb more energy when said shaft is rotating at cut-out speeds and to absorb minimal energy when said shaft is rotating at drying speeds.

22. An apparatus for centrifugally extracting fluids from wet particles including ore slurries, industrial wastes, or coal, including a main frame and an envelope carried thereby for collecting said fluids, comprising, in combination:

(a) a bowl within said envelope and having an opening at one end, a base support at the other end, a filter media liner proximal the inner surface of said bowl for fluid to be centrifugally extracted from the wet particulate in said bowl, and a plurality of angularly spaced ports through which extracted fluid may move outwardly of said bowl into said envelope;

(b) a continuous shaft affixed at one end to said base support;

(c) a gimbal-like system rotatably supporting a second end of said shaft to maintain a vertex of precession of said shaft and bowl at said second end when rotating;

(d) variable speed drive means operatively coupled to said shaft adjacent said vertex to effectively rotate said bowl for centrifugally extracting fluid from said wet particles; and (e) resilient means for supporting said shaft on bearings, said resilient means being located intermediate said bowl and said vertex, with said resilient means being variable in resiliency and constructed to vary the natural radial frequency of said bowl and shaft in accordance with the speed of said drive means.

23. Apparatus as defined in claim 22 wherein said resilient means provides a high natural radial frequency when said shaft is rotating at cut-out speeds to remove dried solids and a low natural radial frequency when said shaft is rotating at drying speeds.

24. Apparatus as defined in claim 22 wherein said resilient means comprises:

(a) a plurality of air bags mounted about said bearing, with the inflation of each bag being independently controlled; and (b) a plurality of support members having a fixed resiliency less than said air bags, with said support members mounted about said bearing in cooperation with said air bags, whereby said bearing may be urged against said support members by varying the inflation of selected cooperative air bags.

25. The apparatus as defined in claim 22 further comprising energy absorption means operatively connected to said bearing intermediate said bowl and said gimbal-like system for absorbing energy from said shaft and bowl when said shaft is rotating near the natural radial frequency, to stabilize said bowl.

26. The apparatus as defined in claim 25 wherein said energy absorption means comprises shock absorbers of variable energy absorption capability adapted to absorb more energy from said shaft when said shaft rotates at speeds near the natural radial frequency thereof whereby said bowl is stabilized from excessive radial vibration and to absorb minimal energy from said shaft at drying speeds.

27. The apparatus as defined in claim 22 wherein said resilient means comprises: a plurality of air bags mounted about said bearings, with the inflation of each bag independently controlled; and a plurality of support members having fixed resiliency less than said air bags, wherein said airbags and said supports are cooperatively and symetrically positioned about said bearings whereby said bearings are supported by said support members upon deflation of said air bags.

28. Apparatus defined in claim 22 wherein said resilient means for supporting said shaft provides support to said bearing at an area proximal said bowl.

29. Apparatus as defined in claim 22 wherein said bowl is metallic and further comprises an imperforate expandable outer shell with said plurality of angularly spaced ports extending axially at each end of said bowl; and a support for said filter media forming a radially inwardly extending peak intermediate the ends of said outer shell with said support flaring outwardly toward each end of said bowl.

30. An apparatus for centrifugally extracting fluids from wet particulate including ore slurries, industrial wastes, or coal, including a main frame and an envelope carried thereby for collecting said fluids, comprising, in combination:

(a) a bowl mounted for rotation within said envelope and configured to receive said particulate at one end through an opening defined by an inwardly extending annular lip of a radial dimension substantially equal to the thickness of the particulate deposited within said bowl adjacent said annular lip, said bowl having a base support at another end, a filter media liner proximal the inner surface of said bowl for fluid to be centrifugally extracted from the wet particulate in said bowl, and a plurality of angularly spaced ports through which extracted fluid may move outwardly of said bowl into said envelope;

(b) a continuous shaft affixed at one end to said base support;

(c) a gimbal-like unit rotatably supporting a second end of said shaft to maintain a vertex of precession of said shaft and bowl at said second end when said shaft is rotating;

(d) variable speed drive means coupled to said shaft adjacent said vertex to effectively rotate said bowl for centrifugally extracting fluid from said wet particulate;

(e) resilient means for supporting said shaft on bearings, said resilient means being located intermediate said bowl and said vertex, with said resilient means being variable in resiliency and constructed to vary the natural radial frequency of said bowl and shaft in accordance with the speed of said drive means; and (f) means adapted to extend through said opening for introducing particulate into and removing particulate from said bowl.

* * * * *